United States Patent [19]

Massey

[11] Patent Number: 5,017,936

[45] Date of Patent: May 21, 1991

[54] MICROWAVE ANTENNA

[75] Inventor: Peter J. Massey, Crawley, England

[73] Assignee: U.S. Philips Corp., New York, N.Y.

[21] Appl. No.: 403,201

[22] Filed: Sep. 5, 1989

[30] Foreign Application Priority Data

Sep. 7, 1988 [GB] United Kingdom ..... 8821009

[51] Int. Cl.[5] ..... H01Q 13/02; H01Q 13/04

[52] U.S. Cl. ..... 343/773; 343/776; 343/786

[58] Field of Search ..... 343/786, 773, 776

[56] References Cited

U.S. PATENT DOCUMENTS

| | | | |
|---|---|---|---|
| 2,650,985 | 9/1953 | Rust et al. | 343/786 |
| 2,743,440 | 4/1956 | Riblet | 343/786 |
| 2,943,324 | 6/1960 | Sichak | 343/786 |
| 3,171,129 | 2/1965 | Nowakowski et al. | 343/786 |
| 3,653,055 | 3/1972 | Wu et al. | 343/786 |
| 3,938,159 | 2/1976 | Ajioka et al. | 343/786 |
| 4,349,827 | 9/1982 | Bixler et al. | 343/786 |
| 4,667,205 | 5/1987 | Gehin | 343/786 |
| 4,757,326 | 7/1988 | Profera | 343/786 |

FOREIGN PATENT DOCUMENTS 2223850 10/1974 France ..... 343/786

*Primary Examiner*—Michael C. Wimer

*Attorney, Agent, or Firm*—Jack D. Slobod

[57] ABSTRACT

A constant E-plane beamwidth antenna (10), includes a rectangular feeder (12) communicating with a partly cylindrical sectoral horn (14) via a transition (30) positioned in the throat of the sectoral horn. The transition (30) has a plurality of electrically conductive partitions (32) positioned perpendicular to the electric field of a mode propagating, in use, in the sectoral horn (14). The disposition of the electrically conducting partitions is arranged to transport modes which have a constant plane across the surface on one side of the transition into modes which have a constant phase across the surface on the other side of the transition. The transition (30) may be used to control the E-plane beamwidth of an H-plane constant beamwidth horn. Optionally the spaces between the electrically conductive partitions (32) may be filled with a low loss dielectric material.

8 Claims, 2 Drawing Sheets

MICROWAVE ANTENNA

BACKGROUND OF THE INVENTION

1. Field of the Invention

The present invention relates to a microwave antenna, particularly but not exclusively, to a constant E-plane beamwidth antenna.

2. Description of the Related Art

It is well known, for example from U.S. Pat. No. 4,667,205, that the width of a beam radiated by a horn antenna varies as a function of the wavelength and therefore as a function of the frequency. U.S. Pat. No. 4,667,205 discloses a wide band microwave antenna which in a given plane can cover a very wide angular field. The antenna comprises three parts: a rectangular cross section feeder which communicates with a first sectoral horn which is sectoral in the H-plane. The first sectoral horn communicates with a second sectoral horn having a partial cylindrical shape with circular-shaped outer edges. The second sectoral horn comprises top and bottom plates and a plurality of equally spaced, radially extending power distributors. The power distributors comprise metallic partitions extending in the H-plane between the top and bottom plates. The power distributors form a plurality of elementary radiation sources which distribute power across the face of a mouth curved in the second horn's E-plane. Optionally the first sectoral horn may be pyramidal.

The antenna constructed according to U.S. Pat. No. 4,667,205 has a number of drawbacks. One drawback is that the connection between the first and second sectoral horns is a sharp transition which may give rise to undesired reflections and to the generation of unwanted higher order modes. Since each mode propagates at a different speed which is frequency dependent then there will be some variation in the radiation pattern. A second drawback is that the theory behind such a horn is regarded as being very difficult so that it is envisaged that practical horns would be designed empirically by successive experimentation and modification.

SUMMARY OF THE INVENTION

An object of the present invention is to simplify the design of a constant E-plane beamwidth antenna.

According to one aspect of the present invention there is provided a microwave antenna comprising a feeder, a horn section having a throat communicating with the feeder and a mouth, and a transition positioned in the throat, the transition comprising a plurality of electrically conductive partitions positioned transversely to the electric field of a mode propagating, in use, in the horn, the disposition of the electrically conductive partitions being arranged to transport modes which have a substantially constant phase across the surface on one side of the transition into modes which have a substantially constant phase across the surface on the other side of the transition.

According to another aspect of the present invention there is provided a constant E-plane bandwidth antenna comprising a feeder, a sectoral horn connected to the feeder, the sectoral horn being of partial cylindrical shape and comprising a throat which communicates with the feeder and an arcuate mouth bounded by radially extending walls, and a transition disposed at said throat, the transition comprising a plurality of electrically conductive partitions extending transversely of the E-plane of the sectoral horn, the disposition of the electrically conductive partitions being arranged to transport modes which have a substantially constant phase across the surface on one side of the transition into modes which have a substantially constant phase across the surface on the other side of the transition.

The present invention is based on the idea that only the fundamental mode should be excited in the flared portion of the sectoral horn, as the presence of higher order modes can lead to undesirable features in the H-plane pattern. At any fixed radius, the fundamental mode has an electric field which is substantially constant across the E-plane flare of the sectoral horn. At the mouth of the horn this electric field couples to a radiated far field which, for a broad frequency band, is substantially constant in the E-plane over a beamwidth angle which is slightly less than the horn flare angle. Therefore the horn is suitable for use in communications applications where it is necessary to broadcast or receive from only a limited sector of the horizon. The horn feed excites only the $TE_{10}$ mode in the horn flare.

If the feeder should supply the sectoral horn with only the fundamental mode, then only this mode is excited if the field distribution of the feeder matches the field distribution of the mode at the junction of the feeder and the sectoral horn. In fact the fundamental mode of the flare across a cross-section of constant radius is similar to that of the fundamental mode of rectangular waveguide across its cross-section. However, as the cross-sections of the feeder and the sectoral horn are different, a suitable transition must be used to connect the two. The provision of a transition comprising electrically conductive partitions enables the desired match to be achieved.

In an embodiment of the present invention the length of the electrically conductive partitions is such that all the waveguide sections formed by spaces between the partitions and the diverging walls have substantially the same path length.

The antenna may comprise a horn section constituted by an omnidirectional H-plane constant beamwidth horn. The transition for such a horn is arranged to control the E-plane bandwidth of the horn section so that it has an almost constant radiated field in its E-plane for a predetermined broad frequency band. If desired the spaces between the partitions may be filled with a low loss dielectric material. The dielectric material in the spaces adjoining the lateral walls may have a higher dielectric constant than the material in the spaces at the central region of the transition. The use of dielectric material in the transition for an omnidirectional horn is a technique whereby the electrical path length can be increased without a corresponding increase in the size of the horn.

BRIEF DESCRIPTION OF THE DRAWING

The present invention will now be explained and described, by way of example, with reference to the accompanying drawings, wherein.

DETAILED DESCRIPTION OF THE PREFERRED EMBODIMENTS

Figure 1:
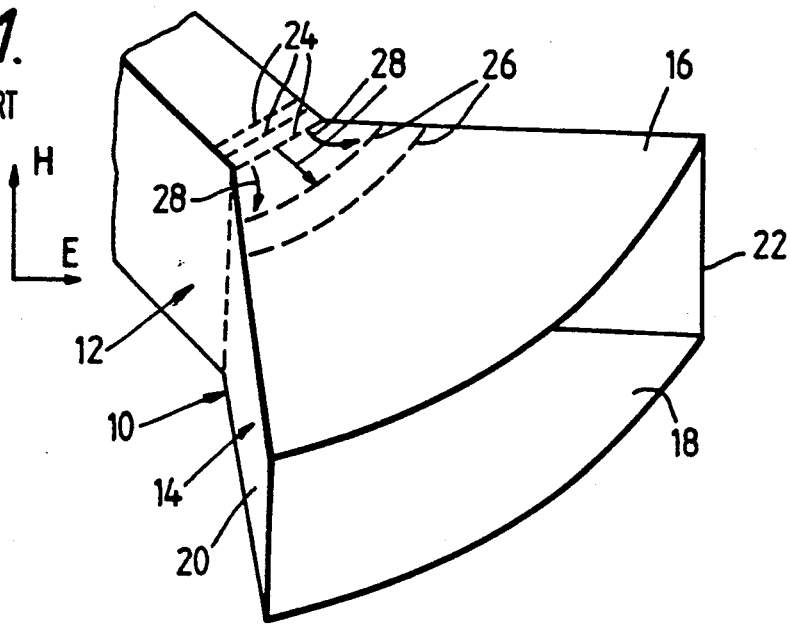
Fig.1. PRIOR ART
FIG. 1 is a diagrammatic perspective view of a known E-plane sectoral horn.

In the drawings the same reference numerals have been used to indicate corresponding features.

Before describing embodiments of the invention it is instructive to consider the known E-plane sectoral horn antenna 10 shown in FIG. 1 which comprises a rectangular feeder 12 connected to a sectoral horn 14. The horn 14 comprises a flared partially cylindrical cavity formed by top and bottom plates 16, 18 lying in the E-plane and, radially extending lateral walls 20, 22 which are orthogonal to the E-plane. The end of the cavity communicating with the feeder 12 is termed a throat and the open end of the cavity is termed a mouth. The outer edges of the top and bottom plates 16, 18 are part-circular, thus defining an arcuate mouth.

The broken lines 24 indicate the wavefronts in the feeder 12 and the broken lines 26 indicate the wavefronts in the flared cavity of the horn 14. The solid lines 28 indicate the path lengths of the wavefronts at the throat region. The path lengths across the feeder-horn junction are greater at its central region than at its edges. Therefore phase differences are generated across the wavefronts which lead to the generation of unwanted higher order modes. The effect of the generation of these unwanted modes is that the width of the beam generally varies with frequency.

Figure 2:
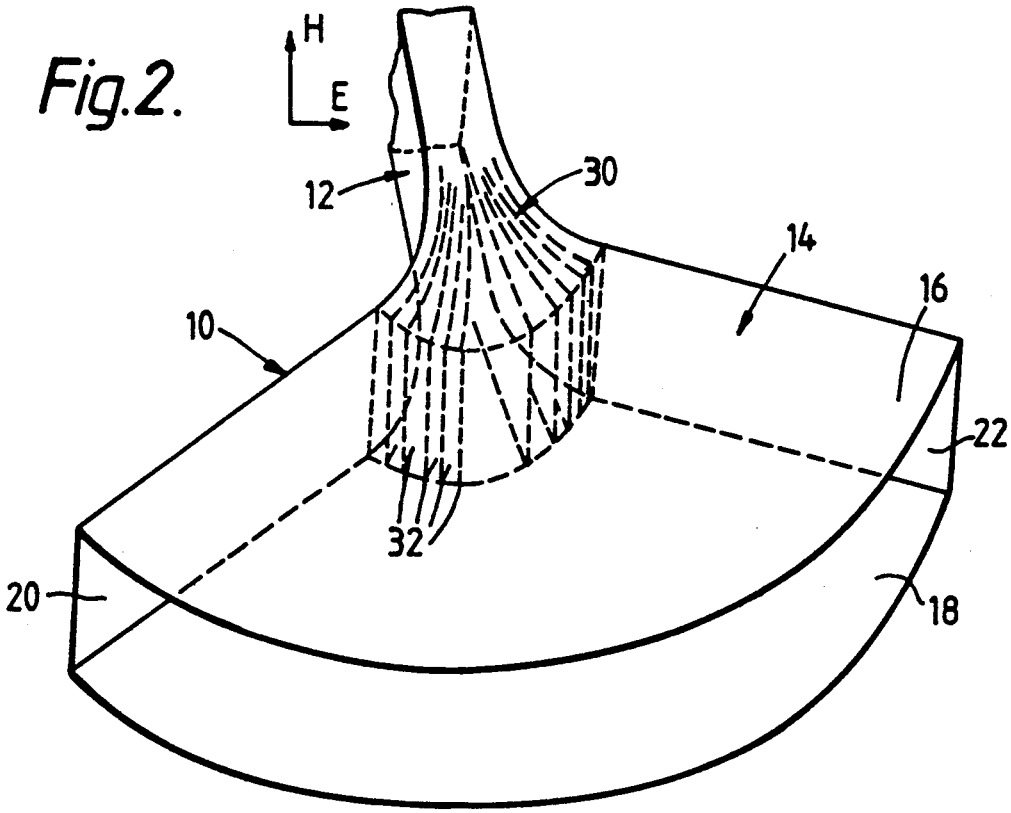
FIG. 2 is a diagrammatic perspective view of an E-plane antenna made in accordance with the present invention.

FIG. 2 illustrates an embodiment of the present invention. The basic construction of the antenna is as described with reference to FIG. 1 and in the interests of brevity it will not be repeated. However, the change of cross-section from the feeder 12 to the horn 14 has been made less abrupt compared to the known antenna. A transition 30 is provided at the throat of the sectoral horn 14 to control the field distribution across the E-plane in the mouth of the sectoral horn 14.

Figure 3:
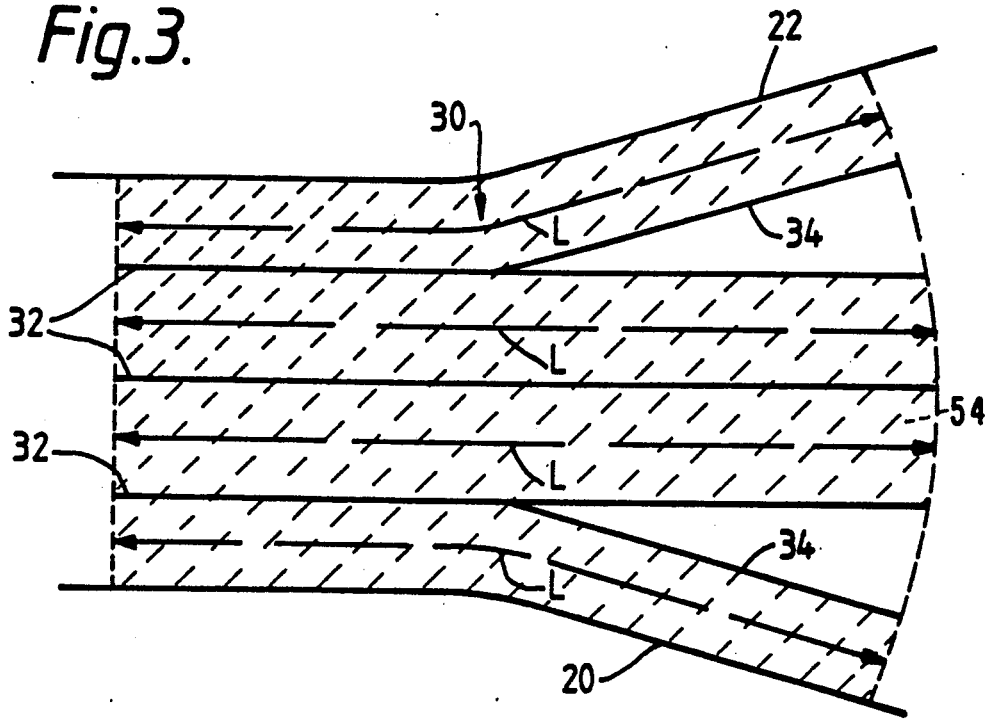
FIG. 3 is a diagrammatic plan view, not to scale of a transition used in the antenna shown in FIG. 2.

Referring to FIGS. 2 and 3 the transition 30 comprises a plurality of conductive partitions 32 extending in the H-plane direction between the top and bottom plates 16, 18, respectively. The lengths of the partitions 32 are equal so that the lengths L of waveguides formed by the spaces between the partitions 32 and between the partitions and the lateral walls 20, 22 are the same. If required additional partition portions 34 may be provided to subdivide sector shaped spaces which are produced by the divergence of the partitions in the sectoral horn 14.

In operation, the feeder 12 supplies the transition 30 with radiation in the fundamental $TE_{10}$ mode. Each of the waveguides constituted by the spaces in the transition 30 are also filled with radiation with the $TE_{10}$ mode. As the propogation constant of this mode depends only on the width, but not the height of the waveguides, then as their lengths L are the same, the electrical path lengths are identical. As the $TE_{10}$ mode has constant phase across each of the waveguides at the input of the transition 30, there is also constant phase across the outputs of the waveguides formed by the spaces between the partitions 32 of the transition 30. Consequently the beamwidth from the mouth of the sectoral horn is largely independent of frequency over a frequency range exceeding an octave.

Figure 4:
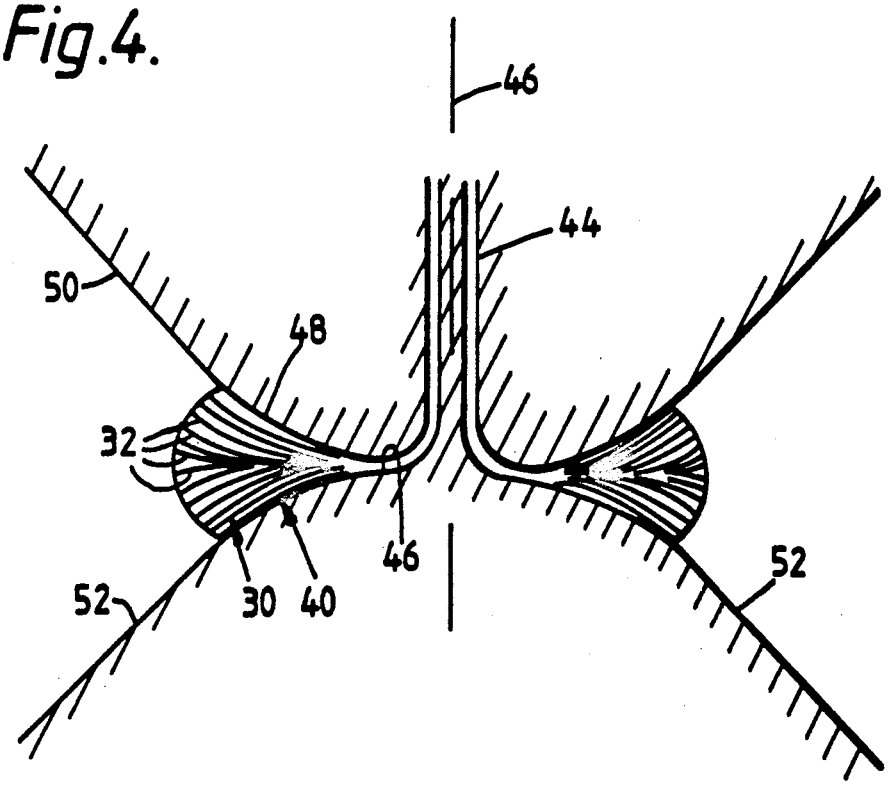
FIG. 4 is a diagrammatic cross-section through an H-plane omnidirectional antenna comprising an E-plane pattern controlling transition.

FIG. 4 shows a cross section through an omnidirectional H-plane antenna 40. The antenna comprises a coaxial feed 46 which communicates with a radial line waveguide 44 which in turn communicates with a horn 48. An annular transition 30 is provided in the throat of the horn 48 for controlling the E-plane pattern of the associated horn 48. The upper and lower walls 50, 52 of the horn have part circular edges which give the horn a partially cylindrical shape as viewed in a plane normal to the plane of the drawing.

The transition 30 is constructed in accordance with the same principles as described with reference to FIGS. 2 and 3. However, unlike as shown in FIG. 2, the transition is annular and the partitions 32 extend in a direction into and out of the plane of the drawing so that they are generally perpendicular to the electric field of the mode propagating within the sectoral horn. The partitions 32 define therebetween a plurality of waveguides of substantially identical length. In this embodiment the transition converts the constant phase front of the fundamental radial line mode at its input into a substantially constant phase front at its output.

If desired, some or all of the waveguide sections formed by the partitions 32 which comprise the transition 30 of the omnidirectional antenna may be filled with a low loss dielectric material 54, as illustrated in FIG. 3. This material will modify the electrical path-length of the electrical signals in the waveguide sections in a substantially frequency independent way. Thus a wider range of input and output surface shape can be phase matched. The introduction of dielectric materials into a transition 30 for a sectoral horn of the type shown in FIG. 2 will lead to problems with dispersion which will cause variations of bandwidth with frequency.

The antennas shown in FIGS. 2 to 4 can be used for transmitting and/or receiving signals.

The transition 30 may be fabricated as a self-supporting sub-assembly which can be inserted into the throat of the sectoral horn.

I claim:

1. A microwave antenna comprising a feeder; a horn section comprising oppositely disposed transversely divergent walls which at their wider spaced ends define a mouth and at their narrower spaced ends define a throat which communicates with the feeder, said walls at the throat curving gradually to provide a smooth change in cross-section between the throat and the feeder; and a transition disposed in said throat having a relatively small end facing said feeder and a relatively large end facing said mouth, the transition comprising a plurality of transversely spaced apart, electrically conductive partitions extending generally co-extensively from said relatively small end to said relatively large end, wherein the lengths of the partitions considered in a direction from said relatively small end to said relatively large end are substantially the same, whereby spaces formed between the partitions and spaces formed between said walls and their adjacent partitions comprise waveguides having substantially identical electrical path lengths.

2. An antenna as claimed in claim 1, wherein the horn section is an omnidirectional H-plane constant beamwidth horn and wherein the transition is arranged to control the E-plane beamwidth of the horn section.

3. An antenna as claimed in claim 1, wherein the spaces are filled with low loss dielectric material.

4. An antenna as claimed in claim 2, wherein a line formed by the intersection of an E-plane and the mouth of the horn section is an arc of a circle.

5. An antenna as claimed in claim 3, wherein a line formed by the intersection of an E-plane and the mouth of the horn section is an arc of a circle.

6. An antenna as claimed in claim 1, wherein a line formed by the intersection of an E-plane and the mouth of the horn section is an arc of a circle.

7. A constant E-plane bandwidth antenna comprising: a waveguide feeder; a sectoral horn formed by a top wall, a bottom wall and transversely divergent side walls connected at their opposite edges to the top and bottom walls, the sectoral horn comprising a throat at a relatively narrow end of the horn which communicates with the waveguide feeder at a junction and which communicates with a mouth at a relatively wide end of the horn formed by edges of the top, bottom and side walls, the divergent side walls at the throat curving gradually to provide a smooth change in cross section between the throat and the waveguide feeder; and a transition disposed in said throat and extending longitudinally from a junction of the waveguide feeder and the throat to a point beyond the gradual curving of the side walls, the transition comprising a plurality of transversely spaced apart, electrically conductive partitions extending longitudinally and between said top and bottom walls in a manner that the spaces formed between the partitions and the spaces formed between the side walls and their adjacent partitions comprise waveguides having substantially identical electrical path lengths.

8. An antenna as claimed as claimed in claim 7, wherein the waveguide feeder is of rectangular cross section and wherein a longer side of the feeder, the radially extending walls and the electrically conductive partitions extend substantially in the H-plane.

* * * * *